United States Patent [19]

Martin

[11] Patent Number: 4,827,652

[45] Date of Patent: May 9, 1989

[54] COCKING-BAR, TARGET-FRAMING AND RANGE-FINDING, CARRYING, HANGING AND STANDING DEVICE

[76] Inventor: Ernest J. T. Martin, 1211 E. Altadena Dr., Altadena, Calif. 91001

[21] Appl. No.: 103,606

[22] Filed: Oct. 2, 1987

[51] Int. Cl.[4] ..... F41C 29/00; F41C 27/00; F41G 1/42

[52] U.S. Cl. ..... 42/100; 42/16; 42/94; 89/1.4; 33/233

[58] Field of Search ..... 42/100, 16, 94, 71.01, 42/72, 73; 89/1.4, 40.06, 37.04; 33/233, 234

[56] References Cited

U.S. PATENT DOCUMENTS

| | | | |
|---|---|---|---|
| 710,660 | 10/1902 | Bennett et al. | 42/100 |
| 1,425,808 | 8/1922 | Thompson | 42/3 |
| 1,425,809 | 8/1922 | Thompson | 42/3 |
| 1,425,810 | 8/1922 | Thompson | 42/3 |
| 1,817,321 | 8/1931 | Payne | 42/3 |
| 2,104,129 | 1/1938 | Kress | 42/72 |
| 2,547,180 | 4/1951 | Taylor | 42/72 |
| 2,826,848 | 3/1958 | Davies | 42/94 |
| 3,236,155 | 2/1966 | Sturdevant | 89/199 |
| 3,599,337 | 8/1971 | Snodgrass | 33/47 |
| 3,611,607 | 10/1971 | Donnell | 42/1 |
| 3,651,736 | 3/1972 | Ingram | 89/132 |
| 3,777,381 | 12/1973 | Moller et al. | 42/100 |
| 3,939,589 | 2/1976 | Tellie | 42/71.01 |
| 3,969,980 | 7/1976 | Brandstatter et al. | 89/33.05 |
| 3,999,946 | 12/1976 | Johnson et al. | 89/191.01 |
| 4,016,682 | 4/1977 | Stratman et al. | 33/254 |
| 4,019,423 | 4/1977 | Johnson | 89/178 |
| 4,020,740 | 5/1977 | Schirneker | 89/129.03 |
| 4,066,000 | 1/1978 | Rostocil | 89/198 |
| 4,502,238 | 3/1985 | Farrar et al. | 42/72 |
| 4,522,105 | 5/1985 | Atchisson | 89/139 |
| 4,663,878 | 5/1987 | Beretta et al. | 42/100 |

*Primary Examiner*—Deborah L. Kyle
*Assistant Examiner*—Michael J. Carone
*Attorney, Agent, or Firm*—Watson, Cole, Grindle & Watson

[57] ABSTRACT

A cocking-bar, target-framing and range-finding, carrying, hanging, and standing device for weapons and firearms, comprises, in its preferred embodiment, a rigid handle of triangular-frame configuration constructed of any ferrous or nonferrous metal alloys or material of similar strength and enduring toughness to withstand repetitive use. This cocking bar is an accessory, adapter and/or replacement device for existing encumbering cocking knobs, cocking handles, cocking bolts or other cocking devices on weapons and firearms. By means of a superior hand-to-surface-area ratio, this device's features are designed to provide augmentation and enhancement of the proficiency of the user's performance in activating the bolt-actuating mechanisms of weapons and firearms in facilitating cocking. The device also serves well in target location, framing and range finding by means of provides striae. The designed aperture of the frame configuration does not block or interfere with existing sighting mechanisms on weapons and firearms, but provides greater and increased accuracy in the use of the standard sighting devices. The cocking bar further comprises in its design a carrying device, a hanging device, and a standing device for maintaining the weapons and firearms at ready or at hand.

8 Claims, 12 Drawing Sheets

COCKING-BAR, TARGET-FRAMING AND RANGE-FINDING, CARRYING, HANGING AND STANDING DEVICE

BACKGROUND OF THE INVENTION

The present invention relates to cocking devices for weapons and firearms.

Historically, the field of cocking devices has been prolifically dominated by cocking devices which have been routinely and nominally designed and economically manufactured for performing a mainly unifunctional purpose in weapons and firearms. However such cocking devices have been found to be undersized, encumbering and only nominally effective as cocking devices on submachine guns, semiautomatic carbines and other types of weapons and firearms which require a cocking device for gripping with the hand and/or fingers in order to cock the weapon.

More specifically, prior art weapons, particularly submachine guns (SMG), semiautomatic carbines and other types of firearms, have been equipped with small, encumbering cocking knobs or small bolt handles to facilitate the accomplishment of cocking. These weapons normally require cocking with each new clip, thereby normally demanding that the shooter re-cock the weapon with the small, encumbering, existing cocking knob each time before a round can be fired.

The existing aforesaid types of weapons and firearms provide the standard cocking knobs, cocking bolts and cocking handles heretofore described which have been small and cumbersome to handle. Further, these cocking devices demand excessive and awkward use of physical strength to force the knob, bolt or handle back the required distance to accomplish cocking. The effort demanded in cocking actions often reaches or exceeds a 20-pound pull. This effort, combined with the small and encumbering cocking devices of minimal facilitating features has resulted in the cocking of the aforesaid weapons being difficult and sometimes painful, injurious or impossible for many persons of lesser physical capabilities, such as wounded persons, many women, the elderly, the handicapped, and those hampered by severe weather and environmental conditions and/or by cramped spaces or encumbering clothing and gloves.

These prior art cocking devices have basically been devised by the military for military uses and/or by private individuals and/or by manufacturers for fabrication at modified expense and often minimal manufacturing requirements in types of weaponry and firearms. This has resulted in facilitating minimal features in the design of the cocking devices in order to accommodate and compliment the design of the firearms. The known prior art weapons and firearms which utilize cocking devices have been constructed without taking into adequate consideration the real-life requirements and facilities of the experienced users' actual situations and circumstances demanding innovative, precise, fast and practical needs for such a device in the action of cocking.

The existing standard devices provided for cocking are awkward, undersized, and encumbering cocking knobs, cocking bolts and cocking handles. They normally accommodate the use of but one or two fingers, or sometimes a finger and a thumb, or the lower palm of the hand. These devices are barely adequate in meeting professional, practical and experienced users' needs. Some prior art devices for cocking of weapons have been found to have awkward, undersized and encumbering cocking devices facilitating disproportionate features designed in such a means and manner as to pinch the side of the finger or the lower palm of the hand if one is not alert and cautious in the action of cocking the weapon. Others dig into the hand or fingers as the result of the strength, force and pressure one must apply against the cocking device. The results have been and are quite uncomfortable and distracting in the cocking of the weapon by such minimally-featured devices. None of the aforedescribed difficulties and encumbrances are needed or desirable in the conditions of battle. Further, they can result in being distracting to the degree that the user's attention is drawn from the enemy, thereby exposing the user to injury or death at the hands of the enemy due to these distracting, encumbering, minimally featured, and undersized devices. None of the aforedescribed difficulties are desirable, nor have they been cognizably discovered by individual shooters using these types of cocking devices on weapons used for sport where repeated cocking is required. And while an increasing number of women today are interested in shooting, many find they cannot cock a number of the firearms on the market today.

One known prior art cocking knob mounted on the top of a weapon includes a sharp-edged, V-shaped slot in its upper surface. This cocking knob can result in physical discomfort and sometimes pain and injury to the hand and/or fingers of user when required to force the cocking knob back against a counter force of one or more compressed, tensioned springs of the firearms' heavy-bolted firing mechanism in order to cock the weapon.

Additionally, heretofore there has been no known prior art providing a design for a significant correction of and reduction in the difficulty of the action of cocking. Nor does the prior art describe a device or devices for cocking, target framing, range finding, and further usable as a carrying handle, hanging device and stand in a singled-piece multiple-purposed device. U.S. Pat. No. 710,659 to Bennett, et.al., issued Oct. 7, 1902, describes a sight featured as a rear-sight slot within a finger-piece or thumb-piece handle cocking device for cocking a semiautomatic weapon. This device moves back and forth as the weapon is fired and as such constitutes a moving cocking device and sight, thus comprising a nonstationary feature in the cocking device. This device is a short, one-finger-activated or thumb-activated device protruding flat, straight upright on its rear portion and concave on its forward portion for finger or thumb gripping.

In the research of prior art pertaining to and inclusive of existing cocking devices such as knobs, handles, levers and bolts, having means of compressed, spring-tensioned and heavy bolts embodied as mechanisms to actuate preparation for firing in numerous weaponry, users, in applying strength of the arm, hand and/or fingers against the provided device in cocking such weapons against resistive springs and heavy bolts, have been found to question, in their action of cocking, whether a round had in fact entered the chamber. Primarily, because the encumbering, undersized cocking devices are forced against the related resistive springs and heavy bolts or breech blocks in cocking weapons, the user has been found to have been uncertain as to whether or not the cocking had been accomplished, and further whether or not the action had brought the spring and bolt system far enough back to engage and inject a round into the chamber ready for firing.

Further, no known devices are constructed to provide an all-inclusive, all-in-one, cocking device, target-framing device, range-finding device, carrying device, hanging device and standing device.

OBJECTS AND ADVANTAGES

Accordingly, the object of my invention is:

to provide a device for rapid ease of cocking, readily reliable for the physical hand, comfortable in handling, and imparting confidence and certainty in cocking submachine guns, semiautomatic carbines and other weapons;

to provide a reliable device for assisting the users of such weapons and other similar hand-held weapons in rapidly cocking the weapons and accurately determining the location of the intended target by framing the target within a clearly demarked frame;

to provide a device which is useable in making range-finding and distance approximations with a minimum of skill;

to provide such a device that will serve as a carrying handle; to provide such a device as to hang or suspend or support such weapons;

to provide a stand to prevent the weapons from being lain in dirt, mud, sand or other objectionable debris or material harmful to the function of the weapons;

to provide a device with an increased ratio of the surface area of the mounted device embodiment to the hand which improves, enhances and facilitates rapid ease of cocking;

to provide a device which requires a minimum of training and skill to use;

to provide a facility which fulfills the needs and corrects the problems researched and found in the purposes, goals and requirements of cocking required by the professional as well as the amateur proponents by this innovative cocking-bar device found necessary for a more optimum function of cocking mechanisms of weapons;

to provide such a device as the all-in-one cocking device that compliments, enhances and provides features that go along with and inherently blends with the designs of weapons.

Additional objects and advantages of my cocking bar will become clear from a review of the accompanying drawings, taken in conjunction with the ensuing descriptions.

DESCRIPTION OF THE DRAWINGS

FIG. 14 shows, in the first preferred embodiment, measured from center to right extremity, definitions of the preferred measurements and proportions of the formed configuration's shape in precise calibrations designed identically from center to the right side and from center to the left side to the extremities. This specifically defines the preferred triangularly configured embodiment of the cocking bar: the handle's horizontal bar, the tapering declining down-angle bars, the mounting flange, and the identically designed slot locks.

DETAILED DESCRIPTION OF THE PREFERRED EMBODIMENT

Figure 1:
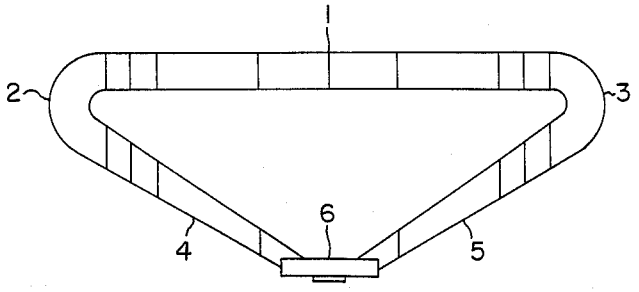
FIG. 1 shows a rear view (shooter's view) of a cocking bar according to a first embodiment of the present invention, the target and range striae (grooves) therein, its mounting flange and the tapering of the declining down-angle bars being clearly shown.

The preferred embodiments of the invented device illustrated and defined are not intended to be exhaustive or to limit my invention to the precise forms disclosed. The disclosures are chosen and described in order to best clarify and explain the principles and facilitating functions comprised and incorporated in my invention, its structure, its applications and its practical usages to thereby enable others skilled in and/or proponents of the usages of the arts and of these devices to best utilize the invention.

In the first preferred embodiment of the single-piece cocking bar depicted in FIGS. 1–6, it is seen to have a triangular-frame configuration, i.e., a rounded, formed handle in the shape of an inverted-isosceles-triangular frame. This preferred embodiment includes a horizontal bar 1 having rounded extremities 2 and 3 and two symmetrical, declining, down-angled bars 4 and 5 gradually flaring to its base, a truncated apex having a rectangular-shaped base 6 as a mounting flange. Located on the underside of the mounting flange 6 are two identically dimensionalized, rectangular-solid slot locks 7 and 8 symmetrically positioned and separted by a circular bolt hole 9. Structurally, the described device comprises within its embodied configuration the incorporation of a slot-stud screw 10 and spring-lock washer 11, or alternatively a socket-stud screw 12 and spring-lock washer 13. This incorporation is the structural key to the fastening and securing of the embodied-device cocking-bar invention by the screws 10 or 12 and spring-lock washers 11 or 13 through the bolt hole 9 in the mounting flange 6 in order to secure the cocking device (FIG. 6) to a weapon and a firearm.

Figure 17:
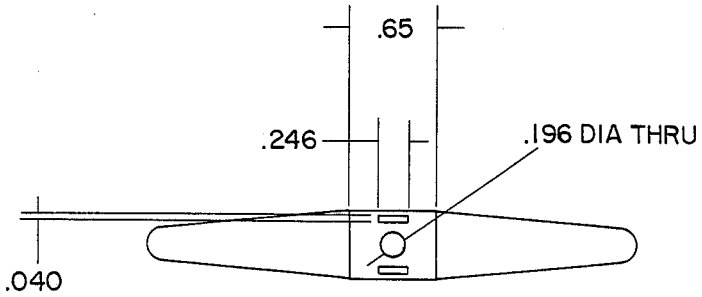
FIG. 17 another bottom view of the cocking bar as shown in FIG. 1, the preferred dimensions of the parts thereof being labeled.
Figure 18:
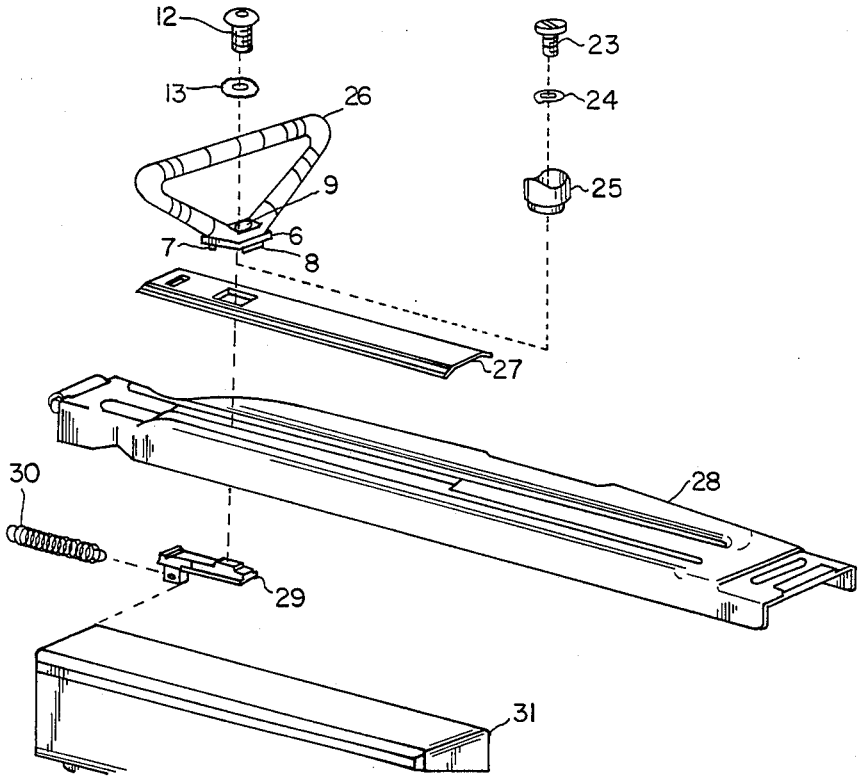
FIG. 18 shows an example of the sequence for the removal of the undersized cocking knob, as an example in an UZI firearm, from its cocking and bolt-actuating mechanism and the cocking knob's replacement with the cocking bar according to FIG. 1. Defining dots indicate the flow removal of the screw, washer and the cocking knob; the dashes define the indicated flow of the assembly replacement of the cocking-bar device mounted by the socket-stud screw through the spring-lock washer and through the mounting-flange bolt hole locking in the swivel-preventing slot locks recessing into the weapon's bolt-actuating mechanism thus mounting the versatile single-piece cocking-bar device for cocking.
Figure 32:
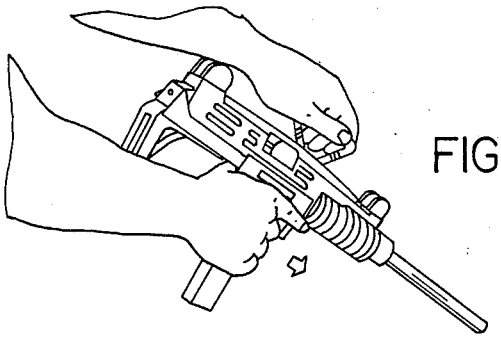
FIG. 32 depicts an UZI being easily cocked by holding the weapon barrel pointing down at a 45-degree angle, holding the inventive cocking bar firmly and pushing the weapon downwardly, resulting in rapid cocking.

The first embodiment of the inventive cocking bar preferably provides certain structural measurements between the structure of the weapons' surface (example as in FIG. 17) and (as in example, the UZI, FIG. 18) the surface of the cocking device due to the embodied construction of types of weapons and firearms comprising actuating-bolt mechanisms upon which the cocking-bar device is mounted (FIG. 17). Thus, the 30-degree angles of the two symmetrically structured declining down-angle bars 4 and 5 of the isosceles triangle (FIG. 1, FIG. 5 and FIG. 6) of the inventive device are to create the calculated, spatial tolerances that separates the cocking bar with the appropriate distances from that of the structural embodiments and surfaces of the bolt-actuating mechanisms of weapons and firearms (as exampled in the UZI in FIG. 18, and 32 and 33 of FIG. 19). These designed spatial tolerances define the independent structures, being the cocking bar and that of the weapons' bolt-actuating mechanism. Although structurally securely mounted, the combined structures of cocking bar and weapon allows for the activation of the two embodiments to function independently without interference on weapons' structures for which the cocking-bar device was designed (FIG. 17 and FIG. 18)

Figure 4:
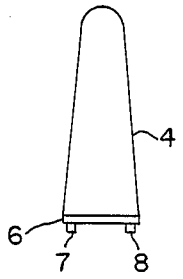
FIG. 4 shows a side view of the cocking bar shown in FIG. 1, the flaring of one of the declining down-angle bars to the mounting flange and thereof the protruding slot locks thereof being visible.
Figure 14:
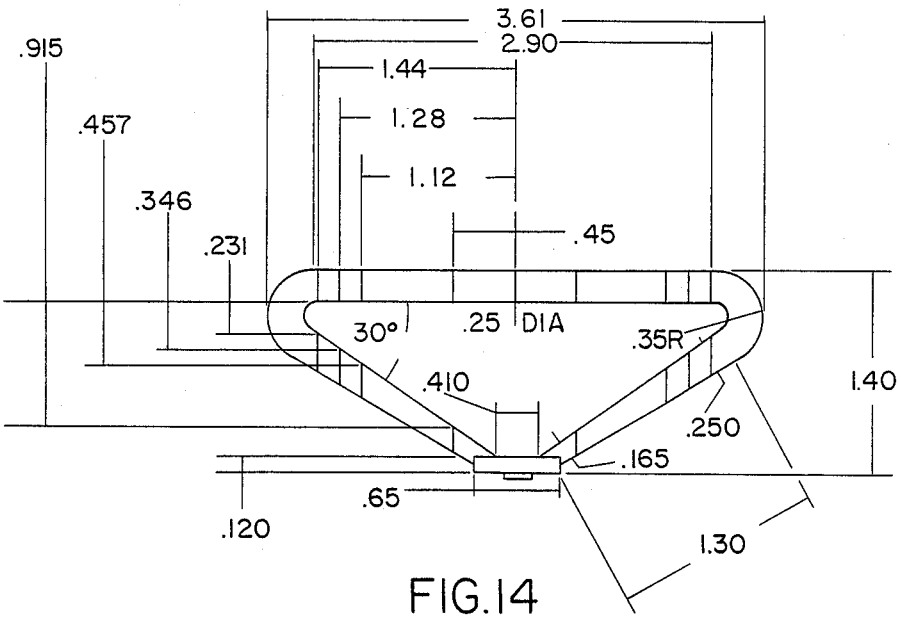
FIG. 14 shows a further rear view of the cocking bar shown in FIG. 1, the striae (grooves) from center to left-end and to right-end extremities of the cocking-bar being shown; further, the striae (grooves) feature the utilization in range finding by the preferred distance from stria to stria, by the positioning and the correspondence of the paired striae (grooves) designed as each depicted on the top horizontal bar and each depicted on the down-angle bars. These striae are identically grooved in corresponding positions and distances from center to right-side and from center to left-side extremities necessarily described in preferred precise measurements and design on the cocking-bar device. Further.
Figure 16:
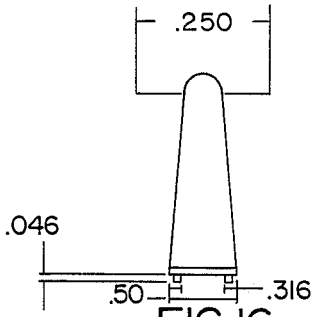
FIG. 16 shows a further side view (either right or left side) of the cocking bar as shown in FIG. 1, the preferred dimensions of the parts thereof being labled.

In FIG. 1, FIG. 4 (numerical references) and FIG. 14, FIG. 16 (dimensions) the embodiment's overall dimensions of the designed device are preferably: height—from horizontal bar 1 to the mounting flange base 6 including the slot locks 7 and 8 measures 1.446 inches; width—between each elbow bend's extremity 2 and 3 measures 3.610 inches; thickness—at the mounting flange 6 measures 0.500 inches (flared) and tapers upwardly to 0.250 inches at the horizontal bar 1.

Figure 2:
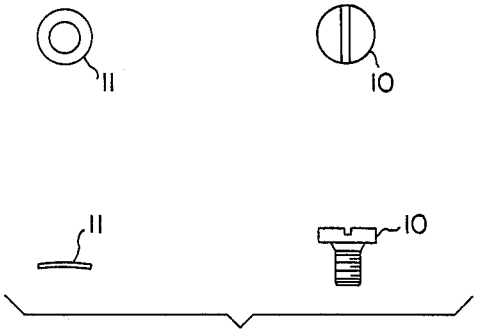
FIG. 2 shows a slot-stud screw and a spring-lock washer that can be used to connect and fasten the cocking bar shown in FIG. 1 to a cocking mechanism of a weapon.
Figure 3:
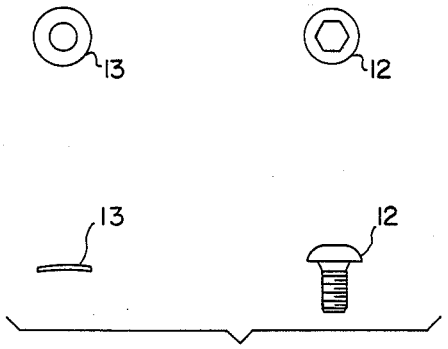
FIG. 3 shows a socket-stud screw and a spring-lock washer that can alternatively be used to connect and fasten the cocking bar shown in FIG. 1 to cocking mechanism of a weapon.
Figure 5:
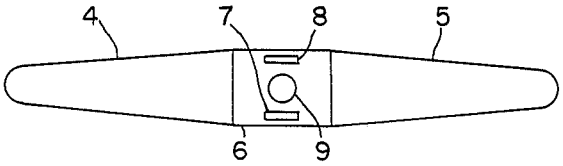
FIG. 5 shows a bottom view of the cocking bar shown in FIG. 1, the declining down-angle bars flaring from the extremities to the base underside of the mounting flange, the position of the slot locks and the stud-screw's bolt hole being visible.

In FIG. 1 (numerical references) and FIG. 14 (dimensions), of the cocking device, the elbow bends 2 and 3 preferably have a bending circular radius of 0.350 inches comprised of 0.250-inch round material. The cocking device's upper horizontal bar 1 (straight portion) preferably measures 2.900 inches. The angles between the horizontal bar 1 and the declining down-angle bars 4 and 5 are preferably 30 degrees. The declining down-angle bars 4 and 5, measured from their points of juncture with the bending elbows 2 and 3 at the termination of the bending angles to their junctures with the mounting flange 6, preferably measure 1.300 inches in length, and preferably taper from 0.250 inches in thickness at the bending elbows to 0.165 inches in thickness at the mounting flange 6. In FIG. 1 (numerical references) and FIG. 14 and FIG. 16 (dimensions) the mounting flange 6 is preferably 0.500 inches in width, 0.650 inches in length and 0.120 inches in thickness. The top surface of the mounting flange, between the edges of the down-angle bars, preferably measures 0.410 inches, being the spatial distance in order to accommodate the slot or socket-stud screw 10 and 12 and lock washer 11 or 13 (FIG. 2 and FIG. 3). In FIG. 4 the slot locks 7 and 8 symmetrically positioned on the underside of mounting flange 6, and preferably measure (FIG. 16 and FIG. 17) 0.040 inches in width, 0.246 inches in length, 0.046 inches in height, and are preferably separated by a distance of 0.316 inches. In FIG. 5 the unthreaded bolt hole 9 located in the center of the mounting flange 6 to accommodate the slot or socket-stud screw 10 or 12 (FIG. 2 and FIG. 3), preferably measures (FIG. 17) 0.196 inches in diameter.

Figure 15:
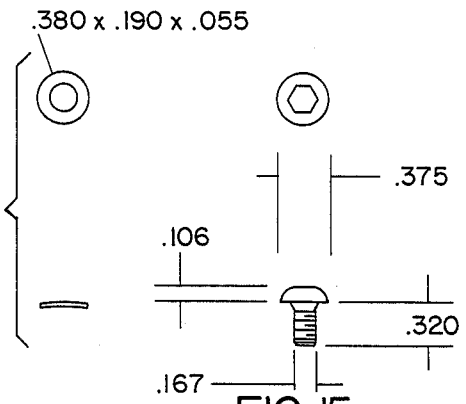
FIG. 15 shows a socket-stud screw, its preferred measured dimensions, and that of a spring-lock washer. The screw and lock washer connect and fasten the cocking bar (FIG. 14) through the mounting-flange stud-screw's bolt hole (FIG. 17) mounting the cocking bar onto the connecting mechanism of a weapon.

The bolt hole 9 facilitates the mounting of the invented cocking device onto the cocking mechanism of a weapon or other mount by means of a coarse, wide-thread slot or socket-stud screw 10 or 12 with appropriate spring-lock washer 11 or 13 (FIG. 2 or FIG. 3) and is further locked in by the secured position of the slot locks 7 and 8, properly recessed into the UZI's cocking mechanism, preventing swiveling and loosening by vibration. In FIG. 15, for mounting on exampled UZI, the preferred socket-stud screw has a shaft length of 0.320 inches, a shaft width of 0.182 inches, a head width of 0.375 inches, a head height of 0.106 inches, and a threading of 1 thread per mm (pitch=1 mm =0.039 inches); the preferred spring-lock washer measures 0.380 inches OD, 0.190 inches ID, and 0.055 inches in width.

Figure 7:
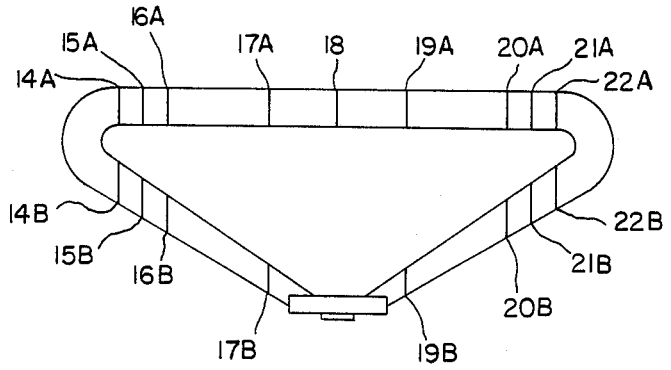
FIG. 7 shows another rear view (shooter's view) of the cocking bar as shown in FIG. 1, the striae (grooves) facilitating range and target settings being provided with reference numerals.
Figure 8:
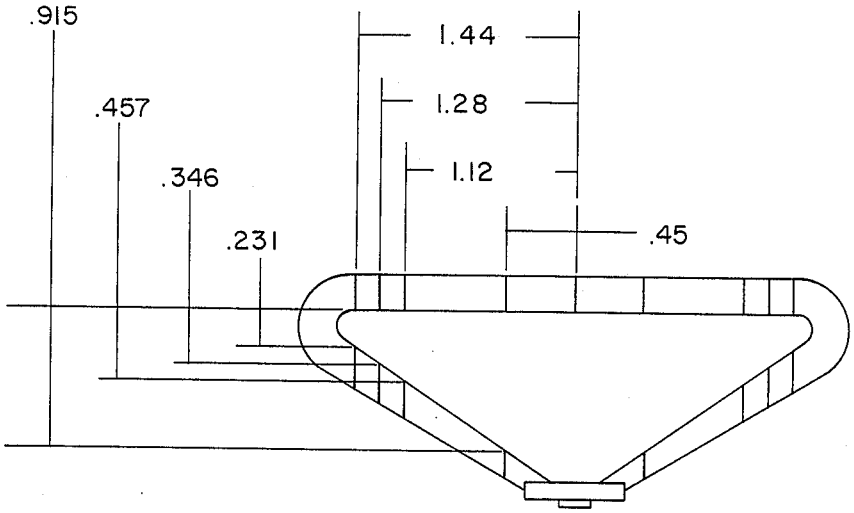
FIG. 8 shows another rear view (shooter's view) of the cocking bar as shown in FIG. 1, the preferred relative distances between the striae therein being identified.

As shown in FIG. 1, the rear surface of the cocking bar includes striae. In FIG. 7 and FIG. 8 a rear view (shooter's view—FIG. 34) of the invention is provided, i.e., as would be seen from the viewpoint of someone in a shooting position holding a weapon on which the invention is mounted. In FIG. 7 and FIG. 8 vertical marked grooves may be seen which indicate the positions of the striae 14A through 22A and 14B through 22B, including 18. A stria consists of a groove, which, in this invention, is used as an aid in sighting and range finding. In this preferred embodiment all striae, 14A through 22A and 14B through 22B, including 18 preferably measure 0.030 inches in width and depth per groove. These striae (grooves) may or may not be painted. Painting the grooved surfaces of the striae tends to give the user more visual definition. Striae 14A through 22A and 14B through 22B, including 18, are placed so as to give the user a stable point of reference when making range approximations. The striae 14A through 22A and 14B through 22B, including 18, are arranged along the horizontal bar 1 and the declining down-angle bars 4 and 5.

In FIG. 7 (numerical references) and FIG. 8 (dimensions), the striae (grooves) are arranged so that a line drawn vertically through a stria on the horizontal bar 1 would pass directly through its counterpart stria on the declining down-angle bars 4 and 5 of the triangular configuration. This provides the eye with a minimum of two stable points by which to measure and make range (distance) approximations on a located target. Measuring horizontally from a centerline drawn through stria 18, the preferred location of the striae measure outwardly toward the extremities in the following order:

Stria 18 (center): 0.000 inches
Striae 17A, 17B, and 19A, 19B: 0.450 inches
Striae 16A, 16B, and 20A, 20B: 1.120 inches
Striae 15A, 15B, and 21A, 21B: 1.280 inches
Striae 14A, 14B, and 22A, 22B: 1.440 inches.

In FIG. 8 the preferable vertical linear distance between striae measure:

Striae 14A and 14B: 0.231 inches
Striae 15A and 15B: 0.346 inches Striae 16A and 16B: 0.457 inches
Striae 17A and 17B: 0.915 inches
Stria 18 (center): 0.000 inches
Striae 19A and 19B: 0.915 inches
Striae 20A and 20B: 0.457 inches
Striae 21A and 21B: 0.346 inches
Striae 22A and 22B: 0.231 inches.

The materials from which the invented cocking bar may be composed and constructed consists of any of the ferrous or nonferrous metals, alloys or suitable rubbers, glasses, ceramics, resins, synthetic plastics, and other substances of sufficient strength and enduring toughness to repeatedly withstand the forces applied against such a structural device in the action of cocking weapons.

In FIG. 1, FIG. 4, FIG. 14, FIG. 16 and FIG. 17 the first embodiment of the inventive device includes a horizontal bar 1 which bends into the declining down-angle bars 4 and 5 and incorporates the mounting flange 6 and the slot locks 7 and 8 as a single-piece device. The embodiment may be cast or forged into the combined triangular configuration as an inverted isosceles triangle with a truncated apex. This embodiment's construction aforedescribed is not limited to or exhaustive in its details and drawings in additional constructions of embodiments and means of forging, casting, welding, machining, or cohesing, as a single-cast or forged piece and/or combined cohesing, welding, forging, singular, sections or embodied parts to accomplish a complete single-piece device of sufficient strength and durability to withstand repeated cocking, carrying, hanging, standing, and firing.

SINGLE-PIECE DEVICE OPERATION

My invention, of the preferred embodiment of the cocking-bar device comprised of the means of performances facilitated in the preferred single-piece device, while not limited to or exhaustive of aforestated and herein stated described designs, structures and functions, incorporates the functions and operations, including: enhancement of the ease and speed of cocking, framing of intended target (especially a moving target), making range approximations, and further providing functions as a handle for carrying or hanging up the weapon, and a raised stand for protecting a weapon's vital mechanisms from dirt, mud, sand or other undesirable substances when putting the weapon down.

Figure 19:
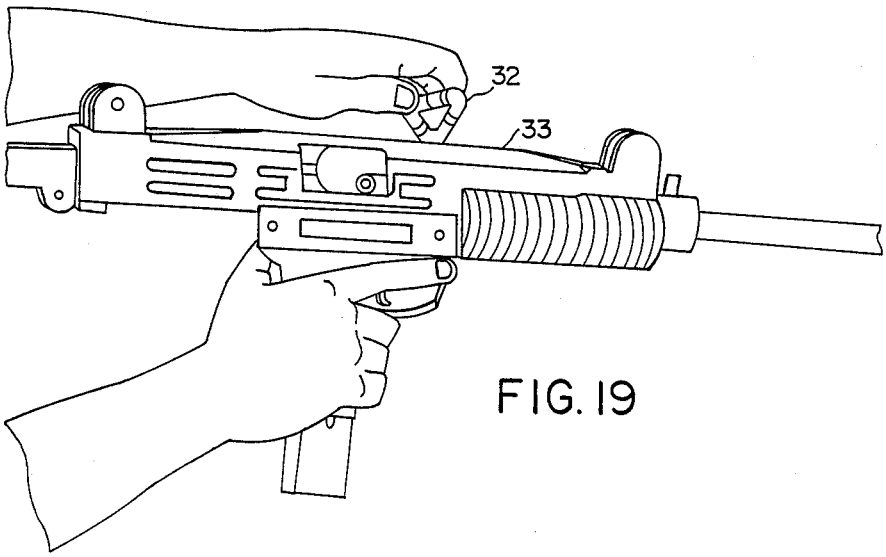
FIG. 19 shows the cocking bar according to FIG. 1 mounted on an UZI submachine gun, the hand of a user being shown grasping the cocking bar to cock the weapon and the space between the declining down-angle bars and the weapon's surface and the safe distance of the user's left hand being visible.

Operations comprised in the functions facilitated by the preferred embodiment of the invented cocking-bar device primarily provide the user with a rigid single-piece device (FIG. 1) with all-inclusive multiple-purpose features (FIG. 9 through FIG. 13 and FIG. 27 through FIG. 38). The working operations of the invented device before mounting requires the user to remove the unmodified, existing, primarily unifunctional stock cocking devices, slot stud screw 23, washer 24 and cocking knob 25 (as exampled in FIG. 18). Once the provided cocking devices are removed, the preliminary steps to secure the invented cocking-bar device are:

(Step A) inserting the socket stud screw 12 through spring lock washer 13 and through the invented cocking bar's provided bolt hole 9 in the mounting flange 6, the invented cocking bar device 26 arranged with the striae side (14A through 22A, 14B through 22B, and including 18 in FIG. 7), facing rearward (shooter's view) as shown in FIG. 19.

(Step B) inserting the aforesaid alignment of parts of Step A, with mounting flange's slot locks 7 and 8 aligned perpendicularly to the weapon's barrel and body, and recessed into the weapon's bolt-actuating mechanism comprised of cocking slot cover plate 27, cover assembly 28, cocking lever 29, cocking lever spring 30, and cocking, breech-block bolt 31 as exampled in the UZI (FIG. 18).

(Step C) Properly torquing down socket screw 12 following aforesaid Step A and Step B secures the invented cocking device by preventing swiveling, loosening or becoming misaligned providing the slot locks 7 and 8 and the socket stud screw 12 and spring lock washer 13 when screwed and torqued, properly lock the embodied invented device securely in place, mounted on these types of weapons.

The working capability of the invented device 26, as an accessory or an adaptor, thus allows the user to interchange back and forth with existing cocking devices 25, thereby utilizing the combination of facilities featured in the all-in-one, single-piece device 26 according to the users' circumstantial preferences and needs as conditions arise.

The preferred all-in-one, single-piece device's 26 invented operations, facilitated as a preferred replacement of existing types of cocking devices 25, incorporates, within the invented device, six functional innovative operations in a singular one-piece device.

The invented cocking-bar as a whole embodied device serves as a handle. The horizontal bar 1 as well as the two declining down-angle bars 3 and 4 joined at the mounting flange 6, may be immediately utilized to carry the weapon, to hang the weapon by means of the invented device or to put the weapon down utilizing the cocking bar as a standing device. Upon being alerted to a target, the user may quickly retrieve and easily cock the weapon, and locate the user's target through the triangular frame as a target-framing device. The user, then, using the range-finding facilities comprised in the invented device, can find the distances of the intended target swiftly and more accurately than without the device, engage in firing the weapon and quickly and easily cock the weapon after each spent clip. The operation and the use of the invented device as described depict the innovative all-in-one functions of the facilitating single-piece device.

THE COCKING-BAR DEVICE: The operations in cocking the types of weapons currently in use require the handling of numerous existing types of cocking knobs, cocking levers and cocking bolts which are undersized, encumbering, awkward and difficult to handle utilizing the arm, the hand and/or fingers combined with the requirement of sufficient physical strength, prowess and ruggedness of fingers and hand to perform the cocking action.

Conversely, the invented device's design having a hand-to-surface-area ratio comprised in the embodied configuration 26 (the horizontal bar 1 to the declining down-angle bars 4 and 5 to the securely fastened mounting flange 6 to the embodiment of weapons), the cocking-force leverage in the hand-to-surface-area ratio to its points of conjunction with the mounting flange is greater in workable operating leverage in the arm, the hand or fingers. This, minimizing the force and strength necessary in the action of cocking, reduces or removes any encumbrance, awkwardness or difficulty in cocking the preferred innovated device on these types of weapons. Consequently, when the embodied invented device 26 is utilized by the user's hand, grip, fingers, palm, etc., and pulled rearward toward the shooter (and naturally released) in cocking these types of weapons, the operation of cocking is done easily, swiftly and with certainty (FIG. 19 and FIG. 27 through FIG. 33).

The operations of working, existing cocking devices in various types of firearms require descriptive differentiation to properly distinguish the invented cocking device. Present and prior cocking devices primarily serve only the purpose of a handle to be used in cocking and therefore activating the breech block loading system of numerous weapons on today's market. When it is required to cock the weapon to begin a cycle of firing or continue a cycle of firing with a new magazine, it is normally a necessity to re-cock the weapon with each new magazine. The pull back of the cocking device requires the depression of one or more highly tensioned springs involved in the breech block mechanism. After cocking, the springs and lever-release mechanism cause the force of the springs to return the bolt to its closed position and has caused the injection of a cartridge into the firing chamber so that firing may occur. It requires considerable physical strength to pull against the spring or springs in cocking. This physical strength must be, in cocking devices in use today, applied by but one or two fingers, or a finger and a thumb together, or by the upper or lower inside portion of the palm of the hand. This puts a strain on those portions of the hand used, as the force must be countered by a small portion of the hand. If this force were spread over a larger surface, the action of cocking would be easier and swifter to perform. This cocking bar invention as precisely designed provides this larger surface. When cocking, all one needs do is grab the bar of the device and pull it back swiftly, easily, and with certainty as provided in the designed embodiment of the device using the hand, palm or fingers without encumbrance, awkwardness or unnecessary discomfort to the user. These innovative improvements are provided to relate to the actions of the user as a result of the increased surface-area ratio of the embodied device to that of the user's hand. Persons of lesser physical powers have been directed to cock the types of weapons equipped with existing cocking knobs, handles and devices and have been unable to do so. When the cocking bar invention was subsequently placed on the weapon, replacing the former cocking devices, they could then successfully repeatedly perform the cocking motions readily, swiftly and with certainty.

I will describe here what has to occur when cocking an exampled UZI. The existing stock cocking knob 25 must be pulled back toward the user. This is usually done with the left hand's palm or fingers and requires a pull of 20 or more pounds for a distance of several inches. Before the cocking knob 25 can be pulled backwards with the left hand, the right hand is required to grasp the pistol grip of the weapon so that the grip safety lever is depressed. The depressing of the safety releases the bolt so that the weapon can be cocked. In actual physical surveys there have been failures to cock the weapon in one, two, and even three tries by some persons, especially women and others of lesser physical abilities and powers. The action requires two hands, with the left being required to perform the most strenuous action. The left arm is usually weaker than the right, contributing further encumbrance to cocking difficulties, not from complexities of design, but from the requirements inherent in the weapon amounting to the quantity of force needed to bring the weapon to cock.

The cocking bar invention liberates the users from the above stated unnecessary conditions. These conditions have been described, tested and experienced by users of numerous weapons including the UZI. The UZI, being an excellently designed, manufactured and proven weapon with its existing cocking knob, has long been utilized by the rugged, well-developed and skilled users. However, thse users as well have welcomed the testing, certainty, assurity, speed and ease of the cocking-bar invention. This testing assures the probability of the broadening of the field of UZI users. These recent non-public, secret testings brought about the refinement of the cocking bar itself and the variety of claims and points of the invention.

Further, users of the UZI and other weapons which provide a cocking knob or bolt are sometimes required to observe and determine as to whether or not they have successfully cocked the weapon. They must find out if in fact a round of ammunition has been chambered. To do this, with the ejection port being on the right side of the weapon, the person must hold the weapon at an off angle to see into the port in order to gain a perception of a round actually chambering. This odd angle, usually with the stock of the weapon butted up against the left hip or the weapon tilted on its side to view it, adds additional difficulties in cocking because of its angle. This odd angle further complicates the entire purpose and action of making the inspection. With the weapon in this awkward position, the absence of optimum muscular coordination by the person makes cocking even more difficult.

It has been actually demonstrated that persons who could not cock the UZI weapon with the standard, stock cocking knob, could perform the cocking requirements easily by use of the cocking-bar invention.

The action of cocking an UZI weapon as mentioned is recommended by the manufacturer or is required in other weapons whenever reloading, that the cocking procedure is followed each time the clip is inserted.

A wounded or injured soldier or law-enforce-ment agent, who, weakened by unattended wounds or injury, but yet still in the battle area, would be able to cock the weapon and continue to defend him/herself with the use of this cocking-bar invention. Battle is a very stressful situation, and to render a wounded hero subject to capture or death because of insufficient strength to ready his/her weapon has never been an acceptable military or law-enforcement condition. This new cocking-bar invention alleviates such conditions.

Figure 33:
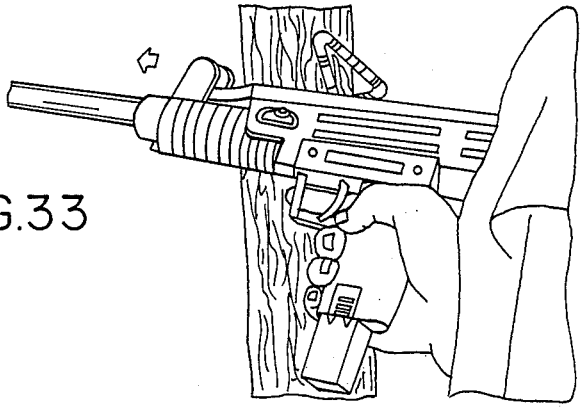
FIG. 33 depicts an UZI being easily cocked by holding the weapon with one hand and pressing the inventive cocking bar against a stanchion, tree or other fixed structure or object and pushing the weapon forwardly, resulting in rapid cocking when one arm or hand is injured or otherwise occupied.

If an arm of an individual were rendered into disuse by reasons of battle, that person would be rendered possibly completely unable to cock his or her weapon with the undersized, encumbering cocking knobs and cocking bolts after reloading. However, with the use of this cocking-bar invention the person is afforded at least a possibility of performing the cocking requirements (FIG. 33). The invention could be placed against a rigid surface and the stock of the weapon could be pushed upon and the cocking could be accomplished with one arm and hand. This is also true of the cocking knobs and cocking bolts presently in use, but because of the small size of the knobs and bolts the difficulty level of the task being successfully accomplished is significantly raised (see 25 of FIG. 18 as exampled in the UZI). This cocking-bar invention does considerably decrease the level of difficulty in cocking as it imparts by design a larger surface area against which to push or pull the embodiment's device.

Persons in cramped positions from lack of space or due to heavy clothing would find the cocking actions more readily performable with swiftness and greater ease with the cocking bar invention. And the stronger, more able user of the aforesaid weapons, who usually have little or no trouble cocking the weapon with the presently existing equipment, have welcomed the new invention. The cocking-bar invention provides them with not only ease of cocking but other features. A description of these features follows.

To sum up the working operation of the embodiment's invented device, particularly describing a prime point designed for strength and durability against the forces and repeated uses of the invented device is described as follows: Besides the spatial description between the invented embodiment 32 and the embodiment of types of weapons 33, the declining down-angle bars 4 and 5 gradually taper more narrowly as shown in FIG. 1. The declining down-angle bars 4 and 5 also flare as they approach the mounting flange 6 as viewed in FIG. 4, FIG. 5, and FIG. 6. The flaring expands to meet the horizontal dimensions of the mounting flange 6 and tapers to meet the vertical dimensions of the mounting flange 6 (FIG. 1). The flaring of the declining down-angle bars 4 and 5 increases the strength of the declining down-angle bars 4 and 5 against the force which is applied while the invention is in use. The points where the declining down-angle bars 4 and 5 meet the mounting flange 6 are most critical points of resistance to force, thus the bars 4 and 5 are flared to provide strength and rigidity, eliminate the possibility of separation, and to insure the force is properly transmitted from the upper embodiment to the lower embodiment, by means of the mounting flange 6, and there mounted and fastened by the slot-stud screw or socket-stud screw 10 or 12, spring-lock washer 11 or 13 to the cocking-bolt assembly of the weapon thus describing the transmission of the central force, the workability of the strength in the embodiment of the configured design of the preferred triangle, and how the invented device operates without jamming or malfunction on types of weapons.

Figure 34:
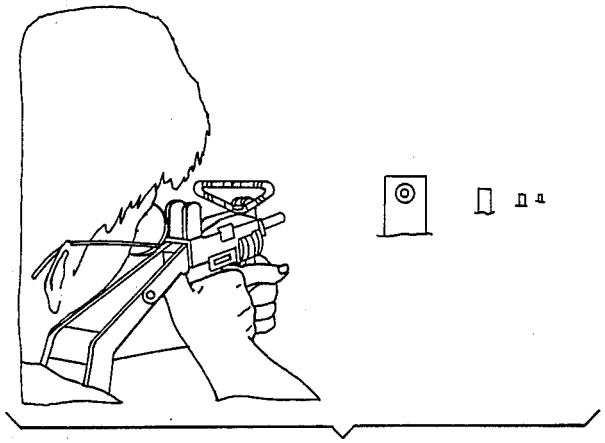
FIG. 34 depicts an UZI with the inventive cocking bar being utilized as a target-framing and range-finding device.
Figure 35:
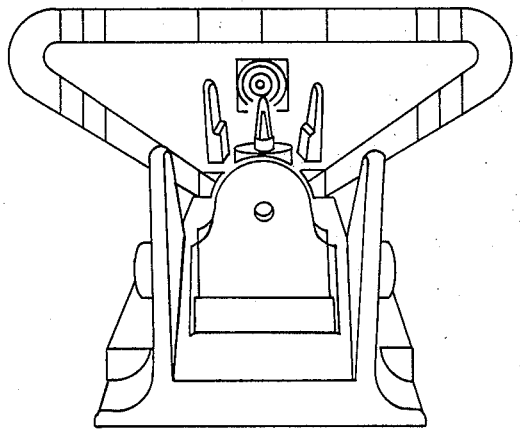
FIG. 35 depicts an UZI with the cocking bar being utilized as a range-finding device, with the striae (grooves) designations for range and distances and as a target-framing device with center stria on the intended target.
Figure 36:
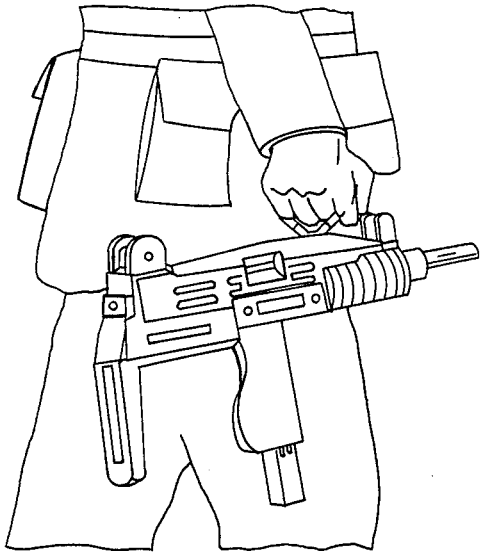
FIG. 36 depicts an UZI weapon with the inventive cocking bar being utilized as a carrying device.

Target Framing: Additionally, the operating cocking-bar invention incorporates and serves as a device by which a target, moving or still, may be rapidly differentiated and defined within the preferred triangular frame (FIG. 34 and FIG. 35). The invention is thus a target-framing device and facilitates this function well by providing an easily discernible space within the frame in which a user may demark or spot a target. Upon familiarity with the target-framing invention, individuals find that they can be consistently and quite accurately on target.

In combined use with the usually provided sights of a weapon, the triangular aspect of the preferred embodiment of the target-framing invention is first used to frame the target and keep it differentiated from other objects. One may then use the provided sighting mechanisms of the weapon. This is especially applicable when the provided sights of a weapon are of the peep-sight variety. Although the peep-sight is quite accurate, it is often difficult to find the target rapidly in the small aperture of the rear section of the peep-sight. This contributes to its accuracy level, but decreases sighting speed, making the target more difficult to find and locate within the peep-hole, particularly a moving target. The framing aspect of the invention may be used to maintain target location on a broader basis whilst setting up to use the peep-sight or other sighting devices.

The target-framing aspect of the invention is not intended as a substitute for the provided sighting mechanisms of the weapon, but rather as an aid in directing and pointing the weapon rapidly and on target (FIG. 34 and FIG. 35). With minimal training and use, individuals, becoming familiar with the invention, may attain a high degree of accuracy and skill of framing speed on selected targets without reference to the usual sights provided on such types of weapons.

This incorporated target-framing aspect of the invention can be of particular use in law-enforcement, combat or war situations where rapid framing and accuracy of targeting are a must for survival. It is a well-known fact of human existence that with proper practice comes efficiency. In battle-stress situations this efficiency becomes highly important and imperative as a soldier or law-enforcement officer must often act immediately in order to preserve his/her life and that of his/her team or those to whom he/she is duty bound to protect. The degree of efficiency of this immediacy of action can be enhanced by the proper use of the target-framing aspect of the invention.

Figure 6:
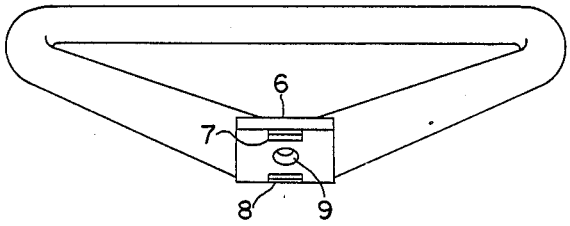
FIG. 6 shows a perspective front view of the cocking bar shown in FIG. 1.

Range Finding: Additionally, the cocking-bar invention incorporates and serves as a unique, innovative, range-finding device. In order to accomplish this the range-finding designed art of the invention is equipped with mathematically arranged striae (grooves) FIG. 8 on the rear of the triangular bar. The rear of the bar is the side facing the shooter, away from the target. (The front view in FIG. 6 is devoid of striae.) These striae provide the user a highly simplified but specific method of readily making rapid range (distance) approximations.

Figure 9:
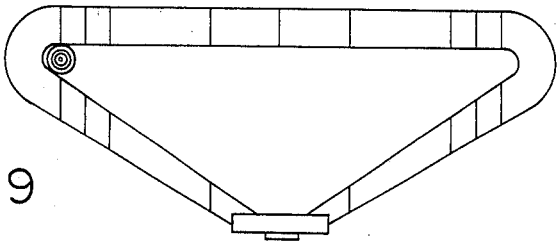
FIG. 9 through FIG. 12 show further rear views of the cocking bar shown in FIG. 1, targets at 100, 75, 50, and 25 yards away being respectively framed therein between respective and corresponding striae pairs as a range-finding device.
Figure 10:
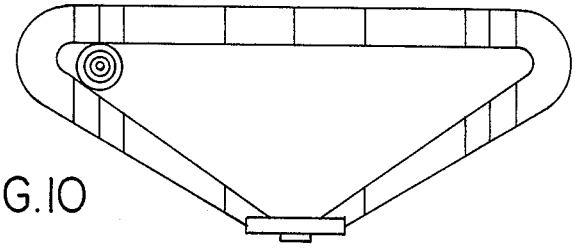
Figure 11:
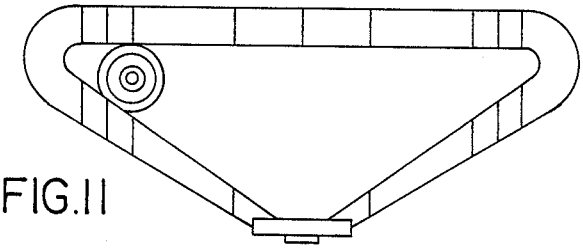
Figure 12:
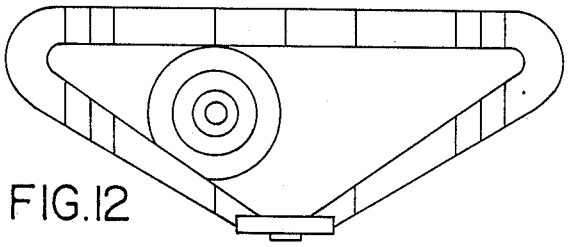
Figure 13:
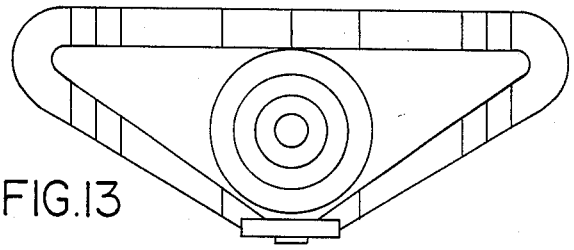
FIG. 13 shows a further rear view of the cocking bar shown in FIG. 1, a target being framed therein at center stria as a range-finding device.

Specifically, when the distance from the shooter's eye to the invention is 13 inches (see FIG. 34), the following data ensues: When striae 14*a* and 14*b* or 22*a* and 22*b* are used as depicted in FIG. 9 and an exampled 5-foot 9-inch target fills the space demarked by the invention, the target is approximately 100 yards distant. When striae 15*a* and 15*b* or 21*a* and 21*b* are used, FIG. 10, and an exampled 5-foot 9-inch target fills the space demarked by the invention, the target is approximately 75 yards distant. When striae 16*a* and 16*b* or 20*a* and 20*b* are used, FIG. 11, and an exampled 5-foot 9-inch target fills the space demarked by the invention, the target is approximately 50 yards distant. When striae 17*a* and 17*b* or 19*a* and 19*b* are used, FIG. 12, and an exampled 5-foot 9-inch target fills the space demarked by the invention, the target is approximately 25 yards distant. In FIG. 13, if the exampled target fills the entire frame, utilize the weapon's bayonet.

The preferred embodiment of the invented device in its design and descriptions defining range finding are not intended to be exhaustive or to limit the invented device. Other approximations may be computed, and other arrangements demarking and depicting approximations or the using the facilities of the striae and their appropriate mathematical equations for range and distance calculations are hereby suggested as further incorporations comprising the designed devices utilized with the aforesaid types of weapons and firearms and by which the invented designed device may incorporate within other weapons.

The preferred device's described features of the striae delineated in grooves may be painted in combinations of singular or varied colors further enhancing the striae's definition and thereby better enabling the user to approximate ranges sighted by means of the defining colors of the striae.

Range approximations are, of course, important in that it is a known fact that bullets do not follow a straight-line trajectory. Weapons and their sightings must be adjusted for distance (FIG. 34). The range-finding design of the cocking-bar invention provides a marked contribution to the user's skill and ability to adapt the range-finding distance to the existing sighting mechanisms on most weapons so that the line of trajectory can be predetermined. The design of this unique range-finding method of this invention is a new and useful novelty in its field.

Carrying Handle: The cocking-bar invention serves in its design to incorporate by its triangular configuration a simplified and practical means to hand carry the weapon (FIG. 36) by the device as a handle. The preferred designed embodiments of the invented device's innovative shape and natural balance due to its mounting location on the applicable types of weapons and firearms, as standard stock cocking mechanisms are centrally oriented, makes it a quite natural act, due to the carrying design aspect of the invention, to carry the weapon by the invention.

Figure 37:
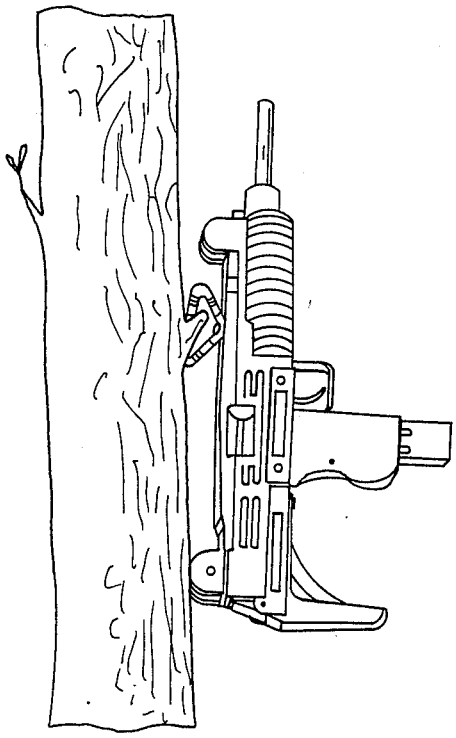
FIG. 37 depicts an UZI weapon being hung by use of the inventive cocking bar as a hanging device.

Hanging Device: The cocking-bar invention serves and provides, in its design, the incorporation by its preferred triangular shape, a means to hang the relevant types of weapons by the invention: such as on a clothes hook, a broken branch, or other such probable protrusions and thereby would be ready for instant retrieval and further use (FIG. 37).

Figure 38:
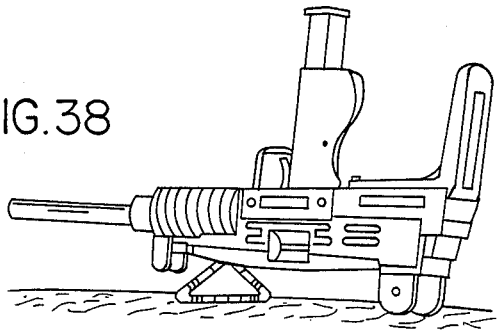
FIG. 38 depicts an inverted UZI weapon with the inventive cocking bar being utilized as a means of a standing device.

Standing Device: The cocking-bar invention incorporates in its design a standing device upon which the applicable types of weapons may be stably rested and supported (FIG. 38). This would require the weapon to be turned and lain upside down with the invented standing device serving as its support. When other weapons that are not equipped with the cocking-bar-standing-device invention are laid down, these weapons are not protected from mud, dirt, sand and other debris into which they may be placed. The standing-device aspect of the invention provides in the design's dimensions and shape, the performance of this standing function on any given surface whether table, floor, or ground and thereby ready for instant retrieval and further use.

In General: I have provided in my cocking-bar invention a device which prepares a weapon upon which the device is mounted to be instantly retrievable from the use of the device as a stand or when hung by the device from a protrusion (hook), readily at hand and ready to rapidly cock and frame-in the intended target with proper range approximations as the user is targeting-in during rapid-action conditions; thus the preferred embodiment of the all-in-one, single-piece, innovative device is generally described.

Figure 39:
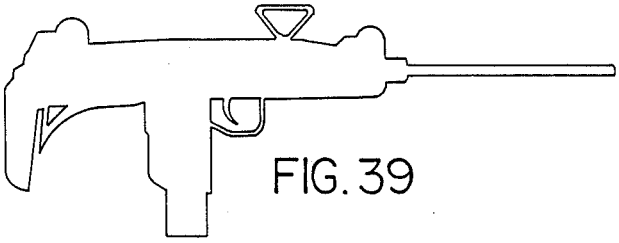
FIG. 39 through FIG. 49 depict silhouetted drawings of several types and models of weapons onto which the inventive cocking bar is mounted.
Figure 44:
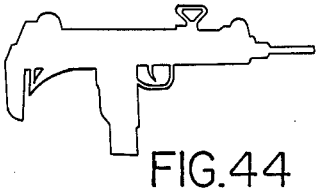
Figure 40:
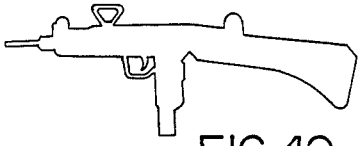
Figure 45:
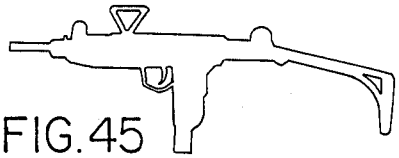
Figure 41:
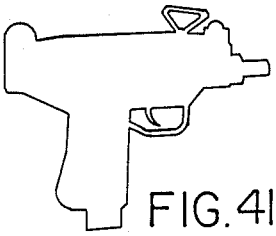
Figure 46:
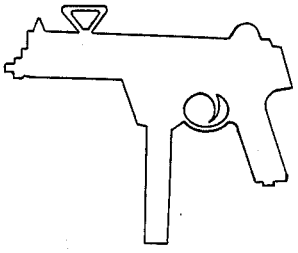
Figure 42:
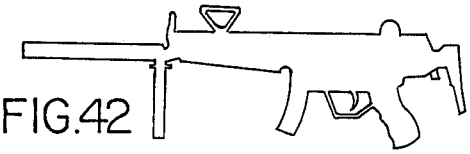
Figure 47:
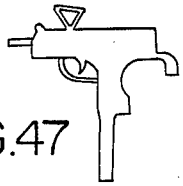
Figure 43:
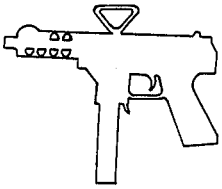
Figure 48:
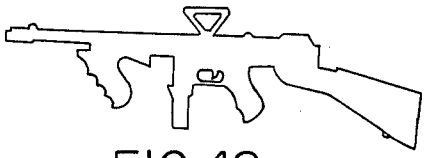
Figure 49:
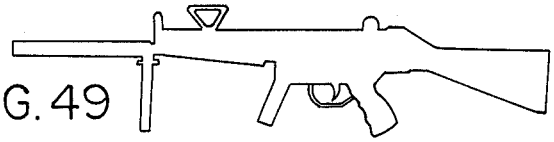

Described are types of weapons and firearms onto which the innovated device may be mounted as depicted in FIG. 39 through and including FIG. 49, as exampled in the UZI types (FIG. 39, FIG. 40, FIG. 41, FIG. 44, FIG. 45), HK 94A3 (FIG. 42) HK 94A2 (FIG. 49), TEC 9 (FIG. 43), WALTHER MPK-S (FIG. 46), INGRAM M-4 (FIG. 47), and the THOMPSON SUB-MACHINE GUN (FIG. 48), and other types of government, military and sporting weapons and firearms. With an additional mounting frame, the invention could be placed on most any firearms or other similar weapons including handguns, shotguns and hunting rifles.

Figure 20:
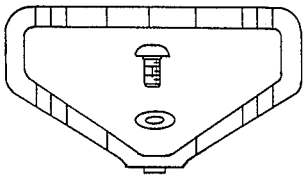
FIG. 20 shows a rear view of a cocking bar according to a second embodiment of the present invention, the cocking bar having a pentagonal configuration and apertured framed form with striae (grooves) for target and range designations, mounting stud screw and lock washer facilitating the cocking bar.
Figure 21:
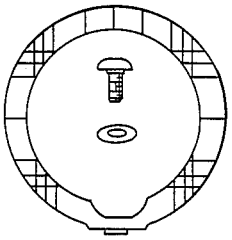
FIG. 21 shows a rear view of a cocking bar according to a third embodiment of the present invention, the cocking bar having a circular configuration and apertured framed form with striae (grooves) for target and range designations, mounting stud screw and lock washer facilitating the cocking bar.
Figure 22:
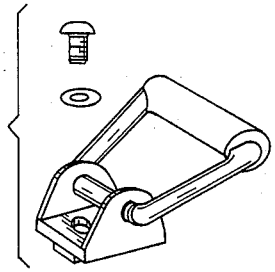
FIG. 22 shows a perspective view of a cocking bar according to a fourth embodiment of the present invention, the cocking bar comprising a spring-bracketed, U-shaped handle with a socket-stud screw and lock washer for fastening the spring-handle cocking device connecting by means of a flat, U-shaped mounting bracket with undercarriage slot locks to the weapon.
Figure 23:
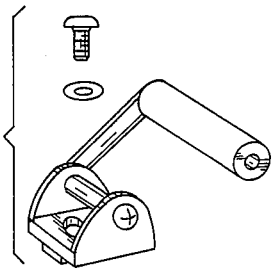
FIG. 23 shows a perspective view of a cocking bar according to a fifth embodiment of the present invention, the cocking bar comprising a spring-bracketed, L-shaped handle with a socket-stud screw and lock washer for fastening the spring-handle cocking device connecting by means of a flat, U-shaped mounting bracket with undercarriage slot locks to the weapon.
Figure 24:
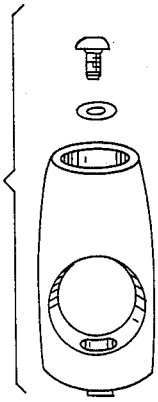
FIG. 24 shows a perspective view of a cocking bar according to a sixth embodiment of the present invention, the cocking bar comprising a cocking handle having an upright hollow tubular configuration with sighting holes through the tubular structure through which sighting is permitted. The upper portion of the hollow tube is open. The bottom of the hollow tube is solid with a bolt hole for a socket-stud screw and washer for fastening the device to weapons. The base of the upright tube configuration is the mounting flange with undercarriage slot locks for recessing and preventing swiveling of the cocking-tube handle when mounted.
Figure 25:
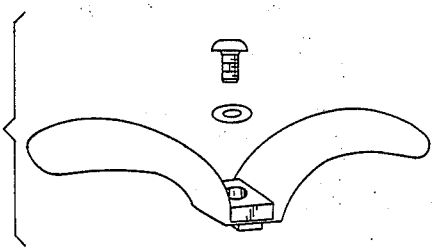
FIG. 25 shows a perspective view of a cocking bar according to a seventh embodiment of the present invention, the cocking bar comprising a winged, V-shaped cocking lever with stud screw and washer for fastening the device to a weapon. The base of the cocking lever having a mounting flange with bolt hole and undercarriage slot locks for recessing and preventing swiveling of the cocking lever when mounted, facilitating cocking.
Figure 26:
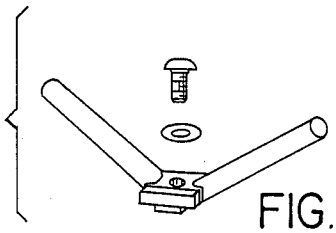
FIG. 26 shows a perspective view of a cocking bar according to an eighth embodiment of the present invention, the cocking bar comprising a V-shaped cocking lever with stud screw and washer for fastening the device to a weapon. The base of the cocking lever having a mounting flange with bolt hole and undercarriage slot locks for recessing and preventing swiveling of the cocking lever when mounted, facilitating cocking.
Figure 27:
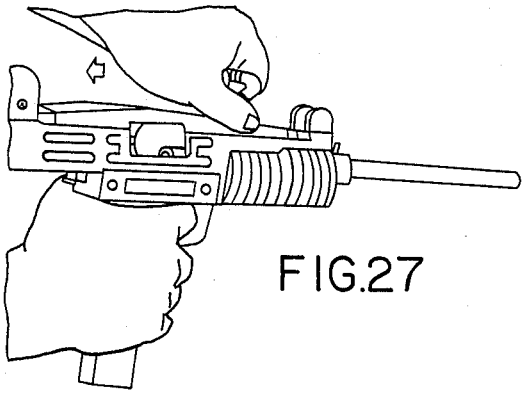
FIG. 27 depicts a straight, horizontal method for rapidly and easily cocking an UZI weapon by pulling the inventive cocking bar rearwardly towards the user.
Figure 28:
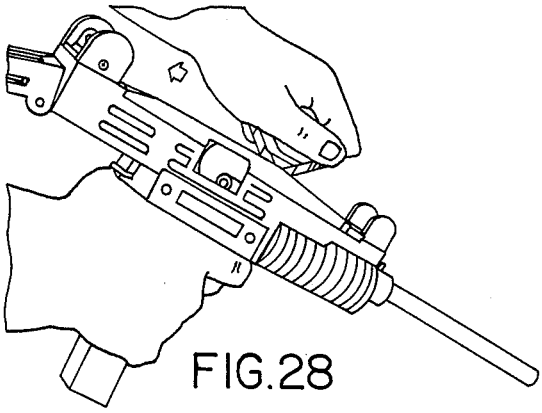
FIG. 28 depicts an exampled UZI being rapidly and easily cocked while held at a 45-degree angle by pulling the inventive cocking bar rearwardly towards the user.
Figure 29:
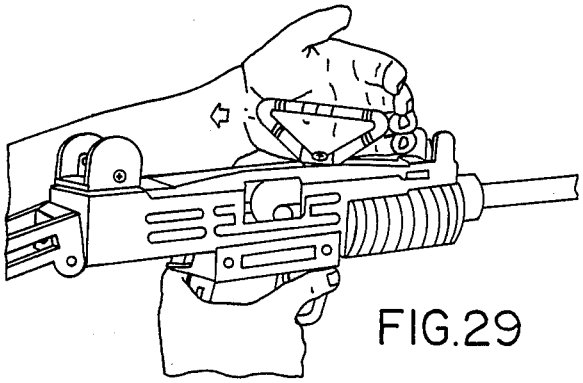
FIG. 29 depicts an UZI being easily cocked using the inventive cocking bar with the palm of the hand pulling the inventive cocking bar rearwardly towards the user.
Figure 30:
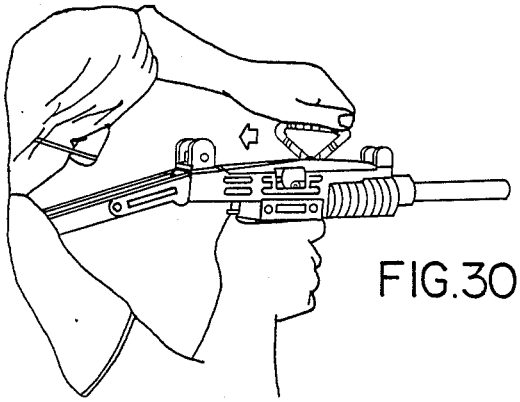
FIG. 30 depicts an UZI being easily cocked by the hand and fingers while the weapon's extended stock is butted against the shoulder of the user and pulling the inventive cocking bar rearwardly towards the user.
Figure 31:
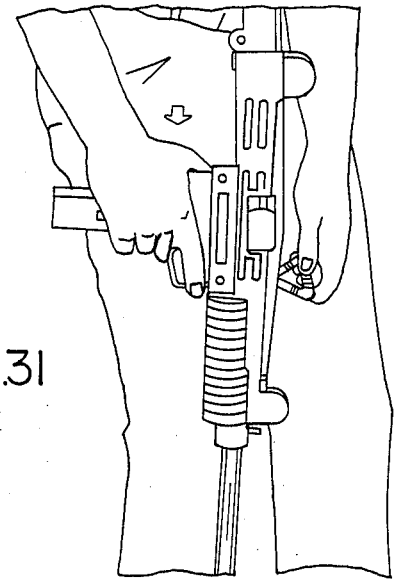
FIG. 31 depicts an UZI being easily cocked by holding the weapon barrel pointing down, holding the cocking bar firm and pushing the weapon downward against the user's firmly held grip on the inventive cocking bar, resulting in rapid cocking.

The inventor's own designs, art, research and development defined herein of the preferred embodiment of the claimed device are not intended to be exhaustive or to limit my invention to precise forms disclosed. Heretofore unrecorded and unregistered publicly; including tests and research archives preceding the complete and final cocking-bar invention to date of this patent application, this invention contains additional aspects of additional designs, claims and specific aspects to the original invention (additional aspects defined from FIG. 20 Through and including FIG. 26) which are stated and defined here in this section of operations of the said invention to ensure other ramifications of my art and invention of its operative claims which are stated and follow herein, and further to protect against any and all illegal equivalencies and circumventions, or elusively appending previously described additives which in the future may unwarrantly infringe upon the fundamental and primary aspects of the claims of my invention.

THE INVENTION'S ALTERNATIVES

The preferred and described embodiments of the invented device illustrated and defined are not intended to be exhaustive or to limit my invention to the precise forms disclosed.

The invented cocking-bar device additionally innovates, from the prime invention of the original cocking bar, further geometrically structured forms and shapes configured rigidly or flexibly as devices for cocking, for target framing, for range finding, for carrying, for hanging and for standing as individual devices and/or as combinations or as an all-in-one inclusive device.

Further comprisements from its original design are described herein to ensure against any speculatory alteration, as an uncircumventable protective feature, the inclusion of valid research designs and designed devices; further, defined and described as alternate designs configured in alternate methods of designing and forming cocking devices, which includes singular usage or combinations of the features primarily and purposely intended in the use of cocking the types of weapons and firearms as a prime invented device shown and depicted in FIG. 20, FIG. 21, FIG. 22, FIG. 23, FIG. 24, FIG. 25, and FIG. 26.

These alternate designs for the described device may be structured and embodied in configured forms as trapezoids, parallelograms, pentagons, trapeziums, helixes, octagons, circles, ovals, hexagons, T-bars with sight hole, oblong, fold-out configurations, right-bar and left-bar configurations, I-bars with sight hole, ankhs, winged forms from central-mounting, forward-lever mechanisms with a reverse-cocking-spring devices, flexible forms, hollow or solid tubing with sight-hole configurations, and other forms of the varied configurations of the above described; the aforesaid configurations being transparent or translucent or opaque, or solid or hollow or honeycombed of the frame structure, or solid forms and the aforesaid in combinations of configurations as design devices as cocking devices, target-framing devices, range-finding devices; carrying devices, hanging devices and/or standing devices and their designed combinations.

The cocking-bar handle in its original design comprises the alternate innovative designs of mounting features by methods of mounting the device by fastening, attaching or affixing, by further alternate means of nuts, bolts, screws, clamps, fasteners, rivets, spring-loaded hinges, welding, casting, adhesives, joineries, cohesives, snaps, clips, webbing, keys, locks, hinges, pins and/or combinations of the above means to facilitate mounting of the devices on the applicable types of weapons and firearms.

The cocking-bar handle in its original design incorporates said alternate designs by comprising a unifying design combining the cocking-bar design into the design of bolt-actuating mechanisms for cocking the applicable types of weapons and firearms in order to construct a new unified operable cocking device combined, into and with the bolt-actuating mechanism, structurally as a single-piece device, as exampled in THOMPSON SMG and other types of weapons and firearms, which may be manufactured by means of being cast, forged, extruded, die struck, machined or combined and unified by being welded, riveted, pressed, braised, and/or combinations of the above means as a unified bolt-activating mechanism cocking device.

The cocking-bar handle comprises in its original design alternate designs of means of materially creating and thus constructing and manufacturing the cocking bar of alternate compositions of materials including, but not limited to, ceramics, plastics, fiberglass, wood, vegetable products, synthetic rubbers, resinous materials, animal products such as bone or ivory, stone, petrified materials, metals including pure, alloyed, ferrous or nonferrous, and/or combinations of the above means in producing the single-piece device or combinations of the designed features of the cocking-bar device.

The cocking-bar handle comprises in its original design alternate designs of alternate target-framing methods by means of various alternative structural embodied configurations having facilitating apertured frames comprised in a structured device for target framing.

The cocking-bar handle comprises in its original design alternate designs of alternate range-finding markings by means of dots, paints, holes, cuts, horizontal striations, angular striations, nipples, lands and grooves, ridges, wires, cross hairs, grids, heat treatments, enameling, galvanizing, plating, blackening, case hardening, blueing, coloring, anodizing, dyes, aluminizing paint, fluorescent paint, phosphorescent paint, mirrors, reflectors, epoxy, etching and/or combinations of the above the means designed to facilitate range finding in a structured device.

The cocking bar handle comprises in its original design alternate designs of alternate dimensions by means of varied thicknesses of bar, shapes of bar, configurations, angles, widths, heights and/or combinations of the above the means designed to facilitate the invented designed device.

The cocking-bar handle comprises in its original design alternate designs of alternate placement locations of the cocking bar on the relevant types of weapons and firearms; therefore the mounting of the invented device is further a conformable design providing adaptations in mounting onto these types of weapons and firearms including locations such as: side embodiments, side mechanisms, surface tops, angled, stocks, barrels, receivers, bridges, balance points, grips or handles, on determined points upon hand guns, shotguns, rifles, and other adaptable types of weapons and firearms to incorporate the comprised invented device.

In conclusion, the detailed summary of the invention's alternatives incorporated from the prime preferred embodied invented device, the cocking bar, and its comprised facilitated functions as a target-framing device, range-finding device, carrying device, hanging device, and standing device, the alternate comprising aforestated descriptions defining alternate facilitating means of producing the innovative ideals of the invented device in part or in parts or as a whole or in combinations, regardless of the proportions and details used in the construction the product, comprises the embodiment of this original cocking-bar invention.

I claim:

1. A cocking bar device for cocking a weapon or firearm having a body or barrel and a bolt-actuating mechanism, said device also being useful for target framing, range finding, and for carrying, hanging and/or standing of the weapon or firearm to which it is attached, said device comprising:

an apertured frame having an inverted isosceles-triangular configuration and consisting of a horizontal bar connected to two downwardly-converging bars which are each tapered and flared along lower portions thereof, said downwardly-converging bars being connected to a mounting flange that includes a bolt hole for rigid mounting to the bolt-actuating mechanism of the weapon or firearm by means of a socket-stud screw and a spring-lock washer, said mounting flange further including protruding slot locks on an underside thereof for aligning and stabilizing said aperture frame perpendicular to the body or barrel of the weapon or firearm when said mounting flange is attached to the bolt-actuating mechanism thereof.

2. A cocking bar device according to claim 1, comprising vertically aligned striae on a rear side of said horizontal bar and said down-angle bars to facilitate range finding.

3. A cocking bar device according to claim 2, comprising one central stria located on the rear of said horizontal bar and eight pairs of vertically aligned striae located on the rear side of said horizontal bar and said down-angle bars.

4. A cocking bar device according to claim 2, comprising one central stria and eight pairs of vertically aligned striae, wherein said central stria is located on the rear side of said horizontal bar directly on a central axis of said device, said axis passing directly through said bolt hole in said mounting flange, wherein two pairs of said vertically aligned striae are located right and left 0.45 inches from said central axis, wherein two pairs of said vertically aligned striae are located right and left 1.12 inches from said central axis, wherein two pairs of said vertically aligned striae are located right and left 1.28 inches from said central axis, and wherein two pairs of said vertically aligned striae are located right and left 1.44 inches from said central axis.

5. The combination of a cocking bar device and a weapon or firearm which includes a body or barrel and a bolt-actuating mechanism, said cocking bar device including an apertured frame having an inverted isosceles-triangular configuration and consisting of a horizontal bar connected to two downwardly converging bars which are each tapered and flared along lower portions thereof, said two downwardly converging bars being connected to a mounting flange which is attached to the bolt-actuating mechanism of said weapon or firearm, said cocking bar device being useful to cock the weapon or firearm and for target-framing, range finding, and for carrying, hanging and/or standing of the weapon or firearm.

6. A cocking bar device for cocking a weapon or firearm having a body or barrel and a bolt-actuating mechanism, said device also being useful for target framing, range-finding and for carrying, handling and/or standing of the weapon or firearm to which it is attached, said device comprising an apertured frame having a pentagonal configuration and consisting of a horizontal bar, two downwardly extending, parallel bars, and two downwardly-converging bars which connect with a mounting flange that includes a bolt hole for rigid mounting to the bolt-actuating mechanism of a weapon or firearm by means of a socket-stud screw and a spring-lock washer, said mounting flange further including protruding slot locks on an underside thereof for aligning and stabilizing said apertured frame perpendicular to the body or barrel of the weapon or firearm when said mounting flange is attached to the bolt-actuating mechanism thereof, said apertured frame including vertically-aligned striae on a rear side of said horizontal bar and said two downwardly-converging bars.

7. A cocking bar device for cocking a weapon or firearm having a body or barrel and a bolt-actuating mechanism, said device also being useful for target framing, range-finding and for carrying, handling and/or standing of the weapon or firearm to which it is attached, said device comprising a circular frame which defines a circular aperture therein and a mounting flange to which said circular frame is connected, said mounting flange including a bolt hole for rigid mounting to the bolt-actuating mechanism of a weapon or firearm by means of a socket-stud screw and a spring-lock washer, said mounting flange further including protruding slot locks on an underside thereof for aligning and stabilizing said circular frame perpendicular to the body or barrel of the weapon or firearm when said mounting flange is attached to the bolt-actuating mechanism thereof, said circular frame including vertically-aligned striae on a rear side thereof.

8. A cocking bar device for cocking a weapon or firearm having a body or barrel and a bolt-actuating mechanism, said device also being useful for target framing, range-finding and for carrying, handling and/or standing of the weapon or firearm to which it is attached, said device comprising a hollow tube which has an open upper end and a lower end connected to a mounting flange, said mounting flange having a bolt hole for rigid mounting to the bolt-actuating mechanism of a weapon or firearm by means of a socket-stud screw and a spring lock washer, said mounting flange further including protruding slot locks on an underside thereof for aligning and stabilizing said hollow tube perpendicular to the body or barrel of the weapon or firearm when said mounting flange is attached to the bolt-actuating mechanism thereof, and said hollow tube including aligned openings on opposite sides thereof to provide for target-framing and range-finding sighting therethrough.

* * * * *